US012408709B2

(12) United States Patent
You

(10) Patent No.: US 12,408,709 B2
(45) Date of Patent: Sep. 9, 2025

(54) BABY SWADDLE

(71) Applicant: NINGBO TREENEST CHILDREN PRODUCTS CO., LTD., Ningbo (CN)

(72) Inventor: Beibei You, Ningbo (CN)

(73) Assignee: NINGBO TREENEST CHILDREN PRODUCTS CO., LTD., Ningbo (CN)

( * ) Notice: Subject to any disclaimer, the term of this patent is extended or adjusted under 35 U.S.C. 154(b) by 0 days.

(21) Appl. No.: 18/402,750

(22) Filed: Jan. 3, 2024

(65) Prior Publication Data

US 2025/0212975 A1 Jul. 3, 2025

(51) Int. Cl.
*A41B 13/06* (2006.01)

(52) U.S. Cl.
CPC ..... *A41B 13/06* (2013.01); *A41B 2300/322* (2013.01)

(58) Field of Classification Search
CPC ..... A41B 13/06; A41B 2300/322
USPC ..... 2/69.5
See application file for complete search history.

(56) References Cited

U.S. PATENT DOCUMENTS 2,621,336 A * 12/1952 Wendroff ..... A41B 13/005 2/227
11,889,873 B2 * 2/2024 Williams ..... A41B 13/06
2012/0151654 A1 * 6/2012 Chopak ..... A44B 19/382 5/413 R
2013/0139290 A1 * 6/2013 Barski ..... A41B 13/06 2/69.5
2018/0332902 A1 * 11/2018 Damir ..... A41B 13/065
2019/0208831 A1 * 7/2019 Joshi ..... A41D 15/002
2019/0297954 A1 * 10/2019 Damir ..... A47G 9/083

FOREIGN PATENT DOCUMENTS

CN 209391572 U 9/2019

* cited by examiner

*Primary Examiner* — Timothy K Trieu
(74) *Attorney, Agent, or Firm* — Bayramoglu Law Offices LLC

(57) ABSTRACT

A baby swaddle is provided. The baby swaddle includes a swaddle body, where an upper end of the swaddle body is provided with a neckline; a lower end of the neckline is provided with a first connecting mechanism; the first connecting mechanism extends downwards from the lower end of the neckline to a lower end of the swaddle body; the first connecting mechanism includes one side provided with a left wing portion and the other side provided with a right wing portion; a free end of at least one of the left wing portion and the right wing portion is provided with a first adhesive portion; the first adhesive portion is configured to cover the right wing portion or the left wing portion; and the one side of the first connecting mechanism is further provided with a left leg portion.

12 Claims, 9 Drawing Sheets

BABY SWADDLE

CROSS-REFERENCE TO THE RELATED APPLICATIONS

This application is based upon and claims priority to Chinese Patent Application No. 202221318622.5, filed on May 30, 2022, the entire contents of which are incorporated herein by reference.

TECHNICAL FIELD

The present disclosure relates to the technical field of baby products, and in particular to a baby swaddle.

BACKGROUND

Baby swaddles originally referred to wide slings and blankets used to carry and wrap up babies. Usually, parents use baby swaddles to make newborn babies feel as secure as in the womb, such that babies can sleep soundly without catching a cold.

In the prior art, the most commonly used baby swaddles are blanket-style baby swaddles, which usually include a triangular fabric and a sling. The blanket-style baby swaddle can wrap around the baby's body without being unraveled by the baby so as to keep the baby warm. However, it is inconvenient to use the blanket-style baby swaddle to wrap up a baby, and it will make the baby feel tight and uncomfortable, thereby affecting the sleep of the baby.

In addition, the size of a baby under one year old changes significantly every month, which requires to change the suitable size of the blanket-style baby swaddle according to the size of the baby. Furthermore, as the baby grows rapidly in the first few months, the blanket-style baby swaddle needs to be changed frequently, which is troublesome and wasting.

Therefore, there is an urgent need for a baby swaddle with a wide range of applications for babies of different age stages, strong comfort, and simple operation to meet the needs of mothers and babies.

SUMMARY

In view of the problems of inconvenient operation, poor comfort, and frequent change of baby swaddles in the prior art, the present disclosure provides an improved baby swaddle.

In order to solve the above technical problem, the present disclosure adopts the following technical solution. A baby swaddle includes a swaddle body, where an upper end of the swaddle body is provided with a neckline; a lower end of the neckline is provided with a first connecting mechanism; the first connecting mechanism extends downwards from the lower end of the neckline to a lower end of the swaddle body; the first connecting mechanism includes one side provided with a left wing portion and the other side provided with a right wing portion; a free end of at least one of the left wing portion and the right wing portion is provided with a first adhesive portion; and the first adhesive portion is configured to cover the right wing portion or the left wing portion.

Further, the one side of the first connecting mechanism is further provided with a left leg portion; the left leg portion is located at the same side as the left wing portion; the other side of the first connecting mechanism is further provided with a right leg portion; the right leg portion is located at the same side as the right wing portion; and the first adhesive portion is provided at the free end of the left wing portion and configured to cover the right wing portion.

Further, the first adhesive portion includes one end connected to the free end of the left wing portion and the other end forming a first opening with the left wing portion; a tip of the left wing portion is provided with a second opening that facilitates a left hand of a baby to extend out and is suitable for babies in different age stages; and the first adhesive portion is configured to cover the second opening and adhered to any position of the right wing portion.

Further, the free end of the right wing portion is provided with a third covering portion; the third covering portion includes one end connected to the free end of the right wing portion and the other end forming a third opening with the right wing portion; a tip of the right wing portion is provided with a fourth opening that facilitates a right hand of the baby to extend out and is suitable for babies in different age stages; and the third covering portion is configured to cover the fourth opening.

Further, the baby swaddle is symmetrical about the first connecting mechanism in a left-to-right direction; and when the left wing portion covers the right wing portion, a chest and a portion of a belly of the baby are covered.

Further, one of the first adhesive portion and the right wing portion is provided with a first hook and the other thereof is provided with a first loop corresponding to the first hook; the first hook and the first loop form a hook-and-loop fastener; and the left wing portion and the right wing portion are connected through the first hook and the first loop.

Further, the left wing portion and the right wing portion are integrated with the swaddle body.

Further, there is at least one first hook and at least one first loop; and the first loop has a size greater than or equal to a size of the first hook.

Further, the first adhesive portion is foldable along a connection between the first adhesive portion and the left wing portion, and the third covering portion is foldable along a connection between the third covering portion and the right wing portion.

Further, an inwardly tightened first arc-shaped structure is provided at a transition from the left wing portion to the left leg portion, and an inwardly tightened second arc-shaped structure is provided at a transition from the right wing portion to the right leg portion.

Further, the first arc-shaped structure and the second arc-shaped structure are symmetrical about the first connecting mechanism.

Further, a free end of the left leg portion is provided with a first covering portion; the first covering portion includes one end connected to the free end of the left leg portion and the other end forming a fifth opening with the left leg portion; a tip of the left leg portion is provided with a seventh opening that facilitates a left leg of the baby to extend out and is suitable for babies in different age stages; and the first covering portion is configured to cover the seventh opening.

Further, a free end of the right leg portion is provided with a second covering portion; the second covering portion includes one end connected to the free end of the right leg portion and the other end forming a sixth opening with the right leg portion; a tip of the right leg portion is provided with an eighth opening that facilitates a right leg of the baby to extend out and is suitable for babies in different age stages; and the second covering portion is configured to cover the eighth opening.

Further, the left leg portion and the right leg portion are also integrated with the swaddle body.

Further, the first covering portion is foldable along a connection between the first covering portion and the left leg portion; and the second covering portion is foldable along a connection between the second covering portion and the right leg portion.

Further, the first connecting mechanism is fully or partially openable,

Further, the first connecting mechanism is openable from a bottom to facilitate a diaper change for the baby.

Further, the first connecting mechanism is a zipper, a snap fastener, a button, a belt fastener or a hook-and-loop fastener.

Further, the neckline is square, triangular, or arc-shaped.

Compared with existing products, the present disclosure has the following beneficial effects. The left wing portion is provided with the first adhesive portion, the right wing portion is provided with the third covering portion, the left leg portion is provided with the first covering portion, and the right leg portion is provided with the second covering portion. The design increases the usage state of the baby swaddle and can prevent the baby from catching cold. The baby swaddle is provided with the second opening, the fourth opening, the seventh opening, and the eighth opening, making it easy for the hands and legs of the baby to extend out and suitable for babies in different age stages. The baby swaddle is suitable for babies from birth to around ten months old, with a wide range of applications for babies in different age stages and without the need to change the baby swaddle frequently as the baby grows. The baby swaddle is easy to operate and saves costs. The left wing portion and the right wing portion are integrated with the swaddle body, and the left leg portion and right leg portion are integrated with the swaddle body. The baby swaddle is relatively loose, improving the comfort of the baby. The first adhesive portion and the right wing portion are provided with the hook-and-loop fastener, which facilitates the connection between the left wing portion and the right wing portion.

BRIEF DESCRIPTION OF THE DRAWINGS

The present disclosure will be further described in detail below with reference to the drawings and preferred embodiments. However, those skilled in the art should understand that these drawings are drawn only for the purpose of explaining the preferred embodiments, and therefore should not be construed as a limitation to the scope of the present disclosure. In addition, unless otherwise specified, the drawings are only intended to conceptually represent the composition or configuration of the described objects and may include exaggerated displays, and the drawings are not necessarily drawn to scale.

REFERENCE NUMERALS

Figure 1:
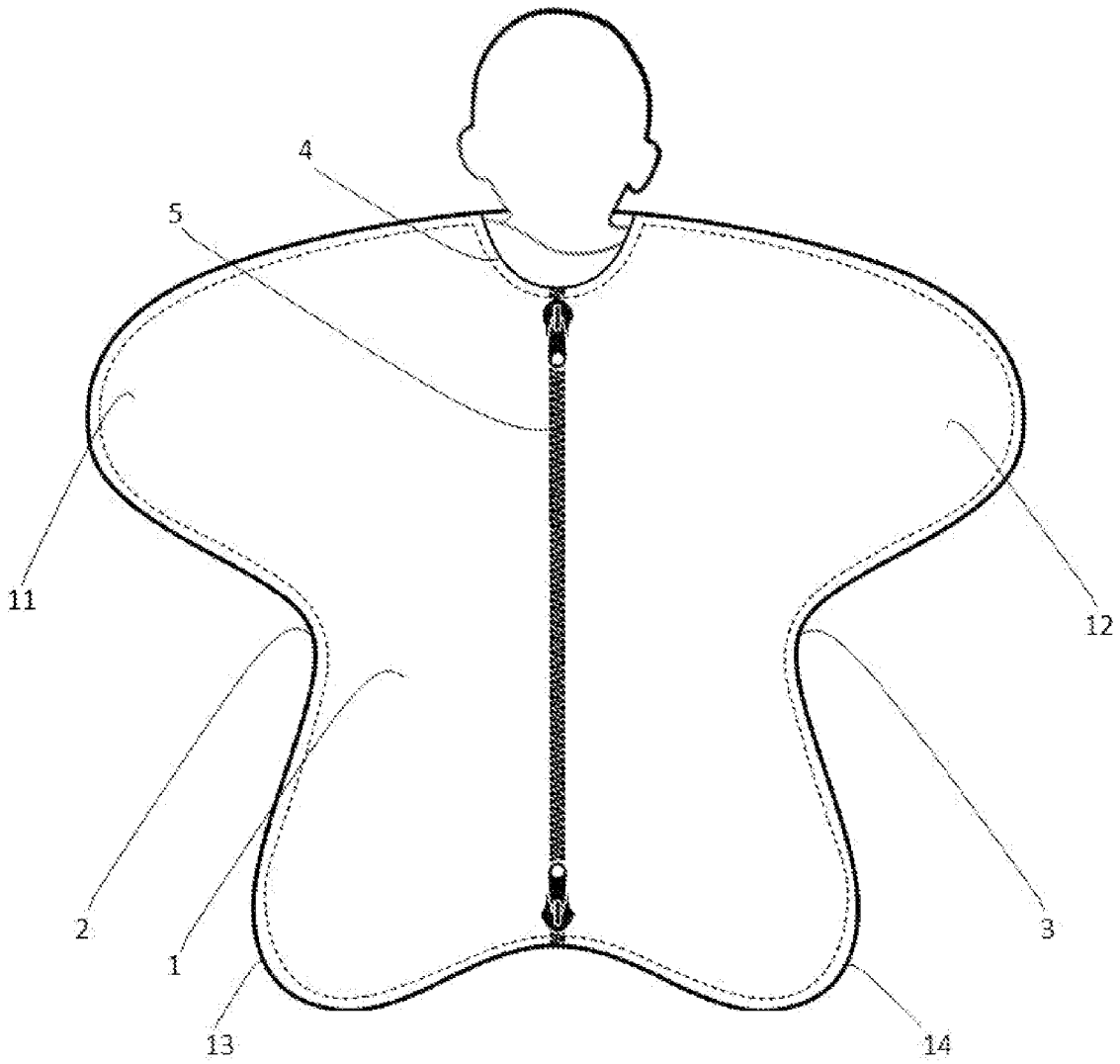
FIG. 1 is a first schematic diagram of a baby swaddle in a usage state.
Figure 2:
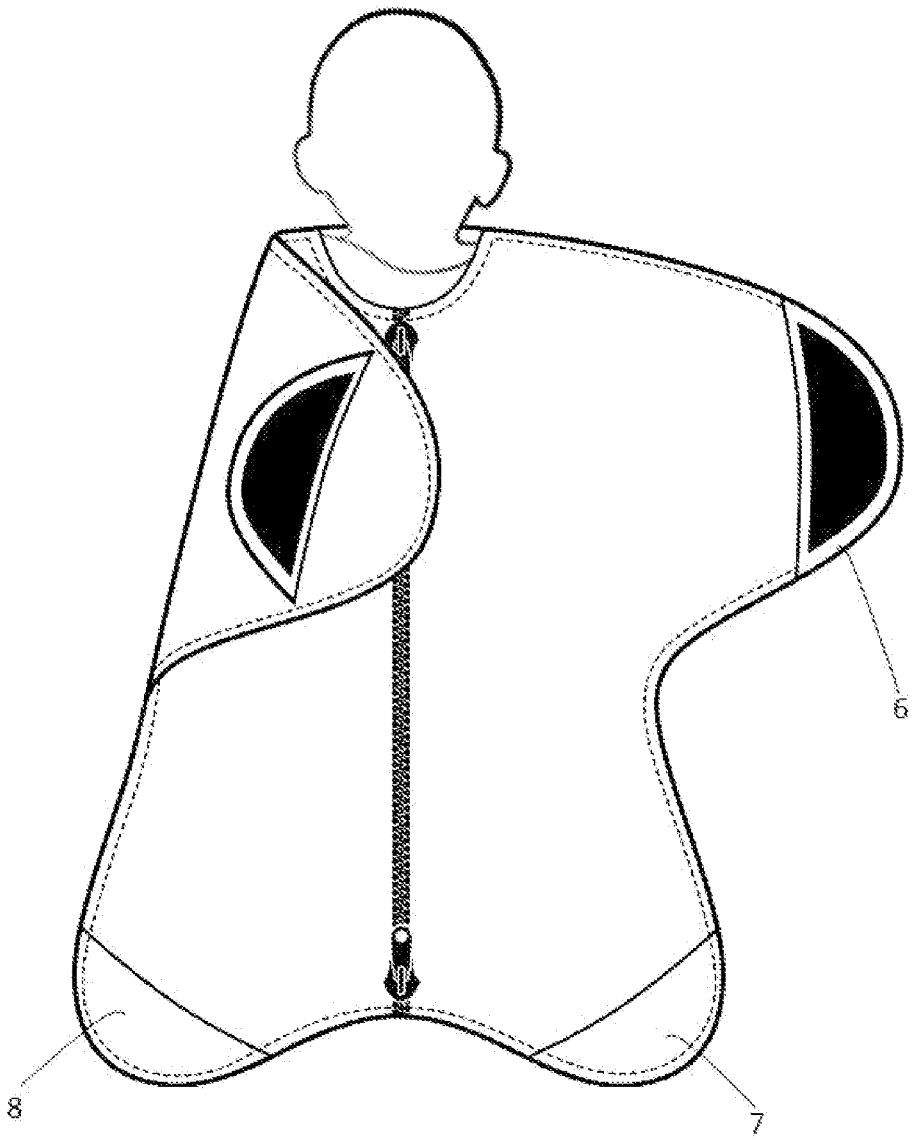
FIG. 2 is a second schematic diagram of the baby swaddle in a usage state.
Figure 3:
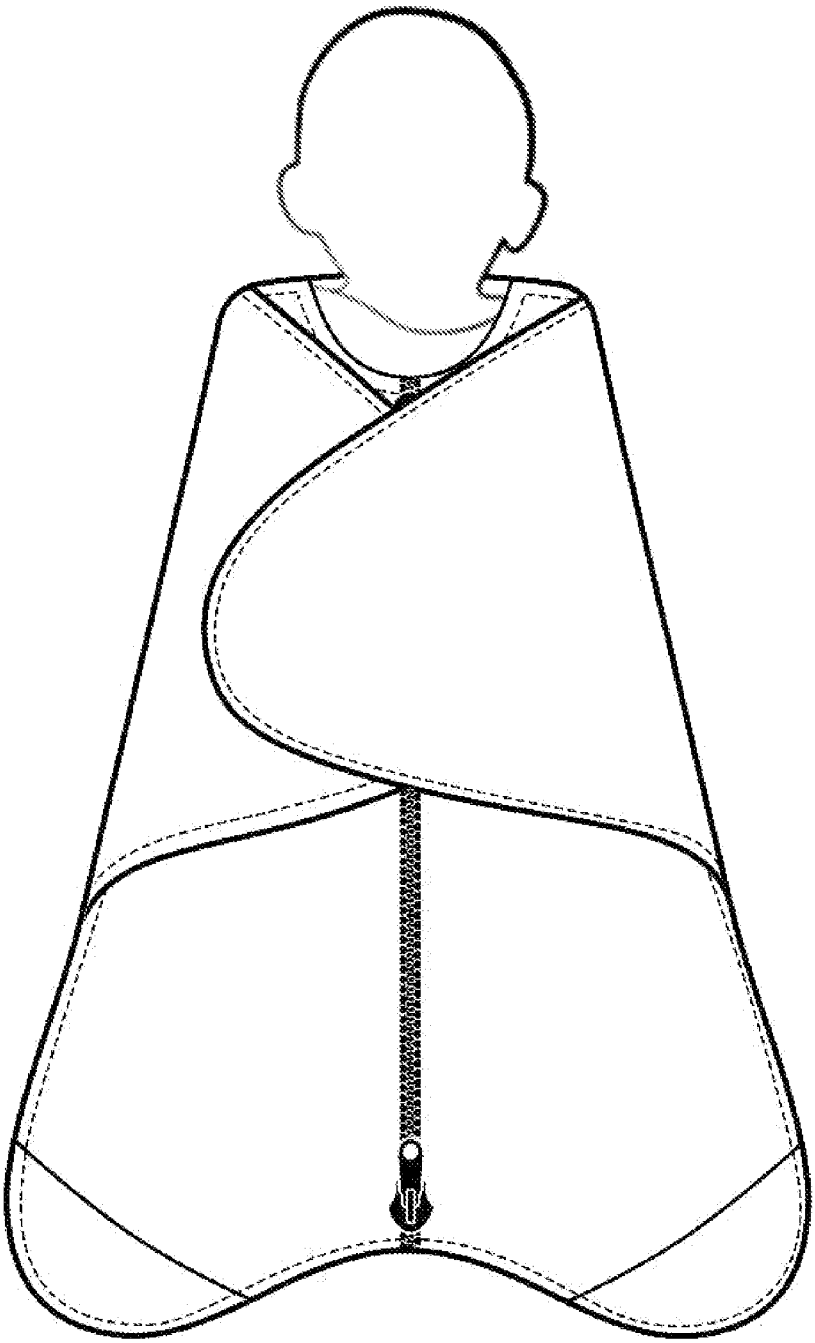
FIG. 3 is a third schematic diagram of the baby swaddle in a usage state.
Figure 4:
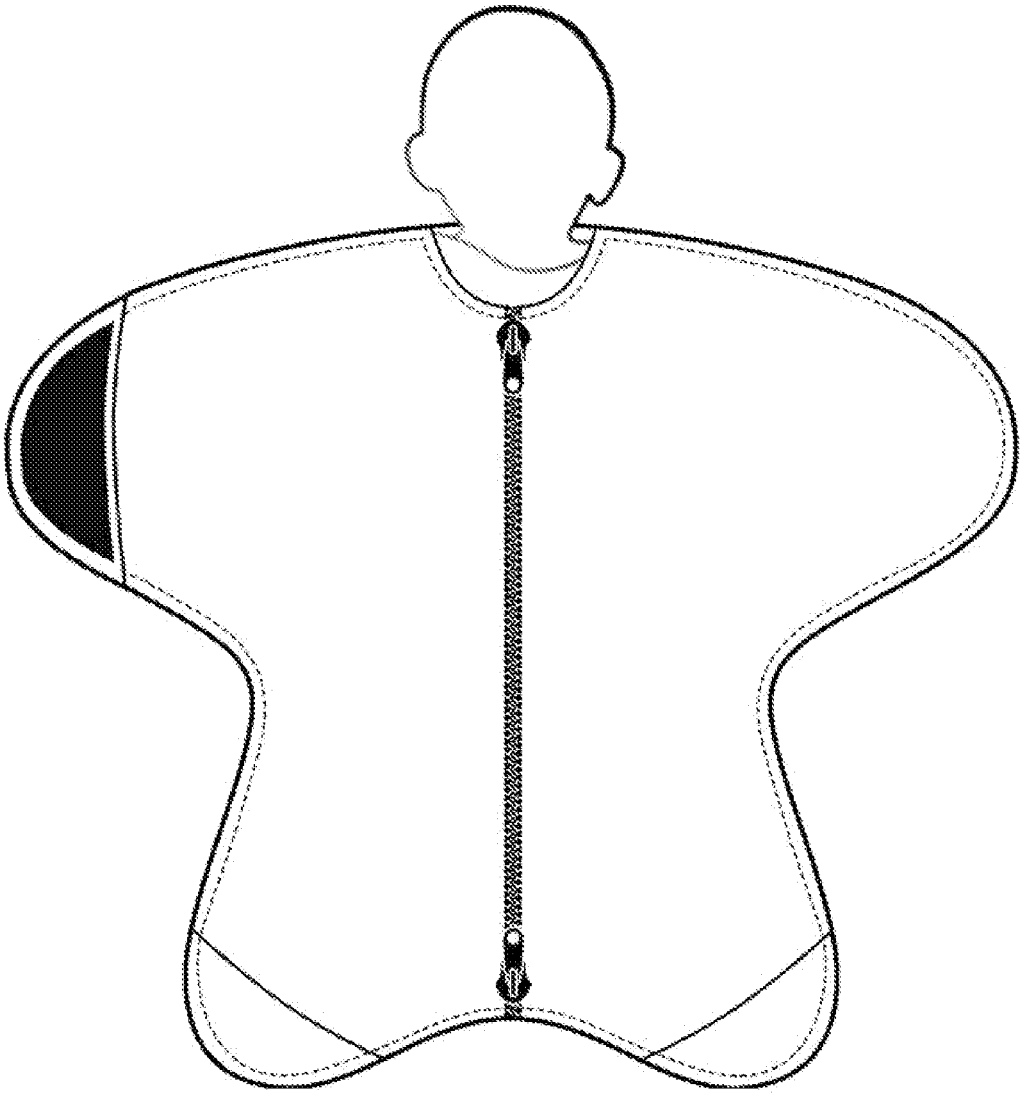
FIG. 4 is a fourth schematic diagram of the baby swaddle in a usage state.
Figure 5:
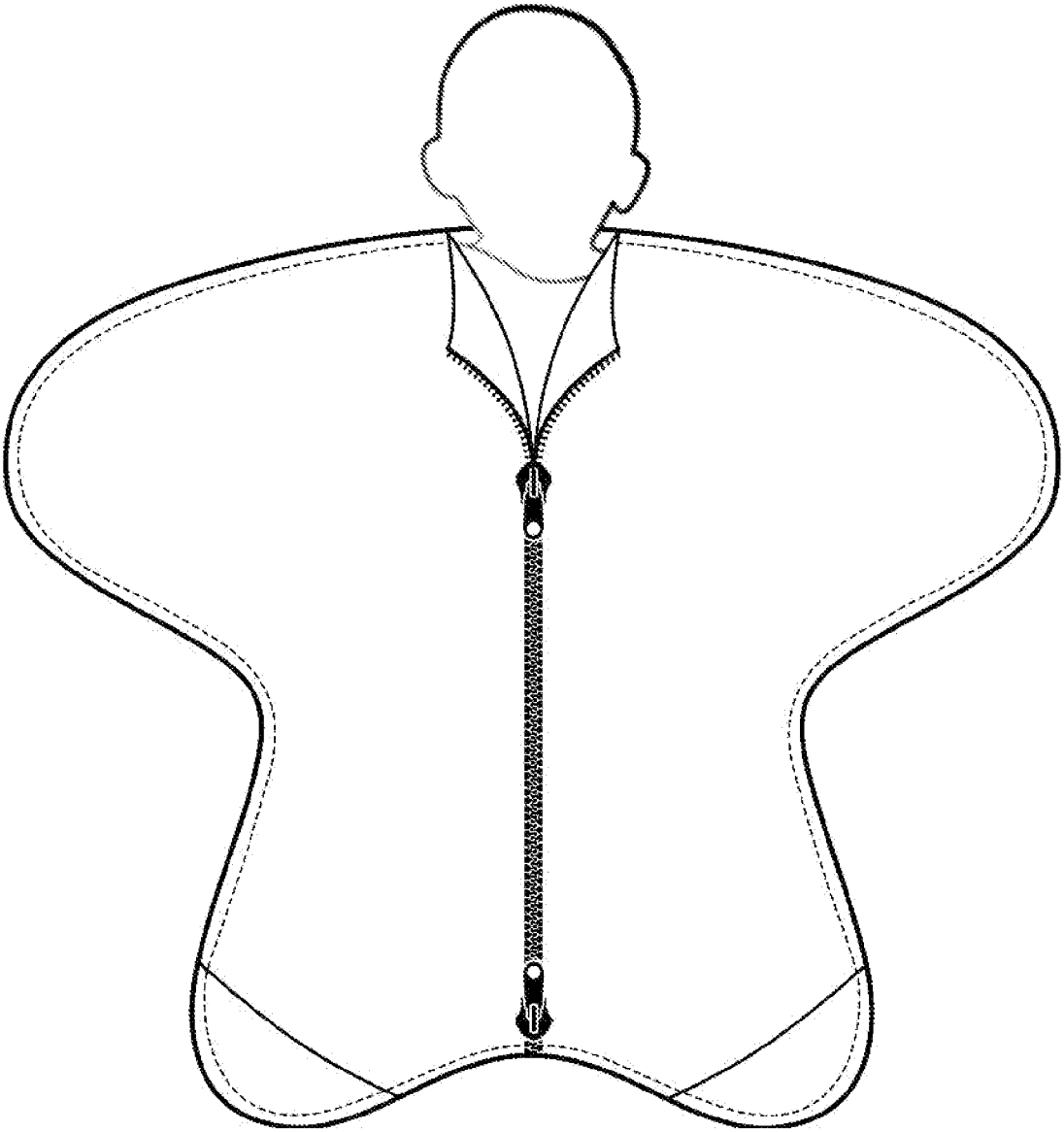
FIG. 5 is a fifth schematic diagram of the baby swaddle in a usage state.
Figure 6:
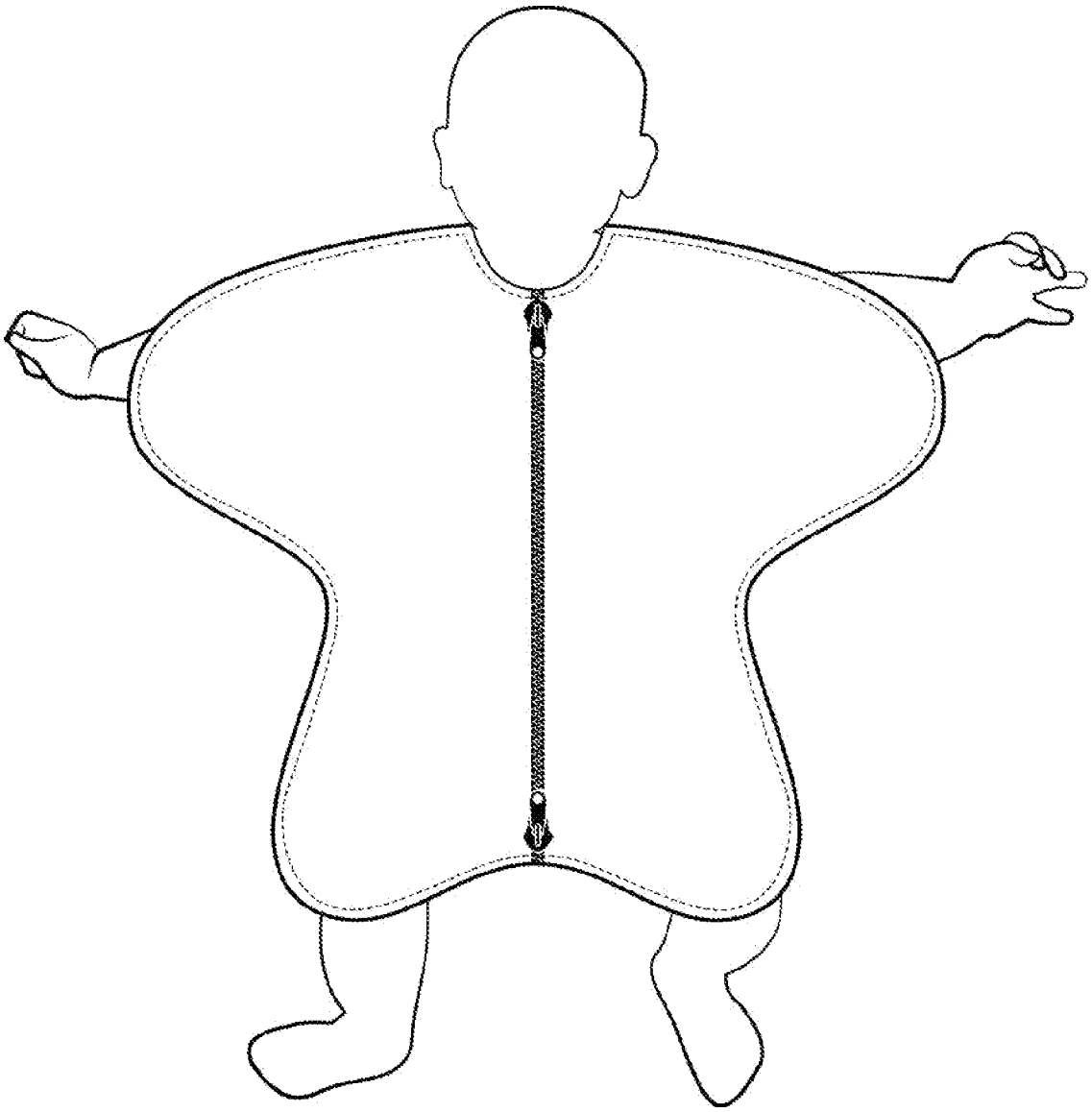
FIG. 6 is a sixth schematic diagram of the baby swaddle in a usage state.

1. swaddle body; 2. second arc-shaped structure; 3. first arc-shaped structure; 4. neckline; 5. first connecting mechanism; 6. first adhesive portion; 7. first covering portion; 8. second covering portion; 11. right wing portion; 12. left wing portion; 13. right leg portion; and 14. left leg portion.

DETAILED DESCRIPTION OF THE EMBODIMENTS

In order for those skilled in the art to better understand the technical solution of the present disclosure, the present disclosure is described in detail clearly and completely below in combination with the drawings and embodiments. It should be understood that the specific embodiments described herein are merely intended to explain the present disclosure, rather than to limit the present disclosure.

It is understandable for those skilled in the art that in the description of the present disclosure, terms such as "longitudinal", "transverse" "upper", "lower", "front", "rear", "left", "right" "vertical", "horizontal", "top", "bottom", "inside", and "outside" indicate the orientation or position relationships based on the drawings. They are merely intended to facilitate and simplify the description of the present disclosure, rather than to indicate or imply that the mentioned system or components must have a specific orientation or must be constructed and operated in a specific orientation. Therefore, these terms should not be construed as a limitation to the present disclosure.

As shown in FIGS. 1 to 6, the present disclosure provides a baby swaddle, including swaddle body 1. An upper end of the swaddle body 1 is provided with neckline 4. A lower end of the neckline 4 is provided with first connecting mechanism 5. The first connecting mechanism 5 extends downwards from the lower end of the neckline 4 to a lower end of the swaddle body 1. The baby swaddle is symmetrical about the first connecting mechanism 5 in a left-to-right direction. The first connecting mechanism 5 includes one side provided with left wing portion 12 and left leg portion 14 and the other side provided with right wing portion 11 and right leg portion 13.

The neckline 4 may be square, triangular, or arc-shaped. Preferably, the neckline 4 is arc-shaped.

In some implementations, the first connecting mechanism 5 may be a zipper. Preferably, the first connecting mechanism is a two-way zipper, which can be opened from top or bottom for convenient use.

In some implementations, the first connecting mechanism 5 may be a button, which can connect the swaddle body to provide warmth and exquisite and aesthetical appearance.

In some implementations, the first connecting mechanism 5 may be a snap fastener. The snap fastener includes a socket and an eyelet, which can be combined and separated with just one press or pull, making it convenient and fast for use. The snap fastener is usually invisible and has a small volume, and will not hurt the baby.

In some implementations, the first connecting mechanism 5 may be a belt fastener, including two belts provided at corresponding positions of the swaddle body and tied together to connect the swaddle body.

In some implementations, the first connecting mechanism 5 may be a hook-and-loop fastener, which is convenient and simple to operate, and saves costs and space.

Figure 7:
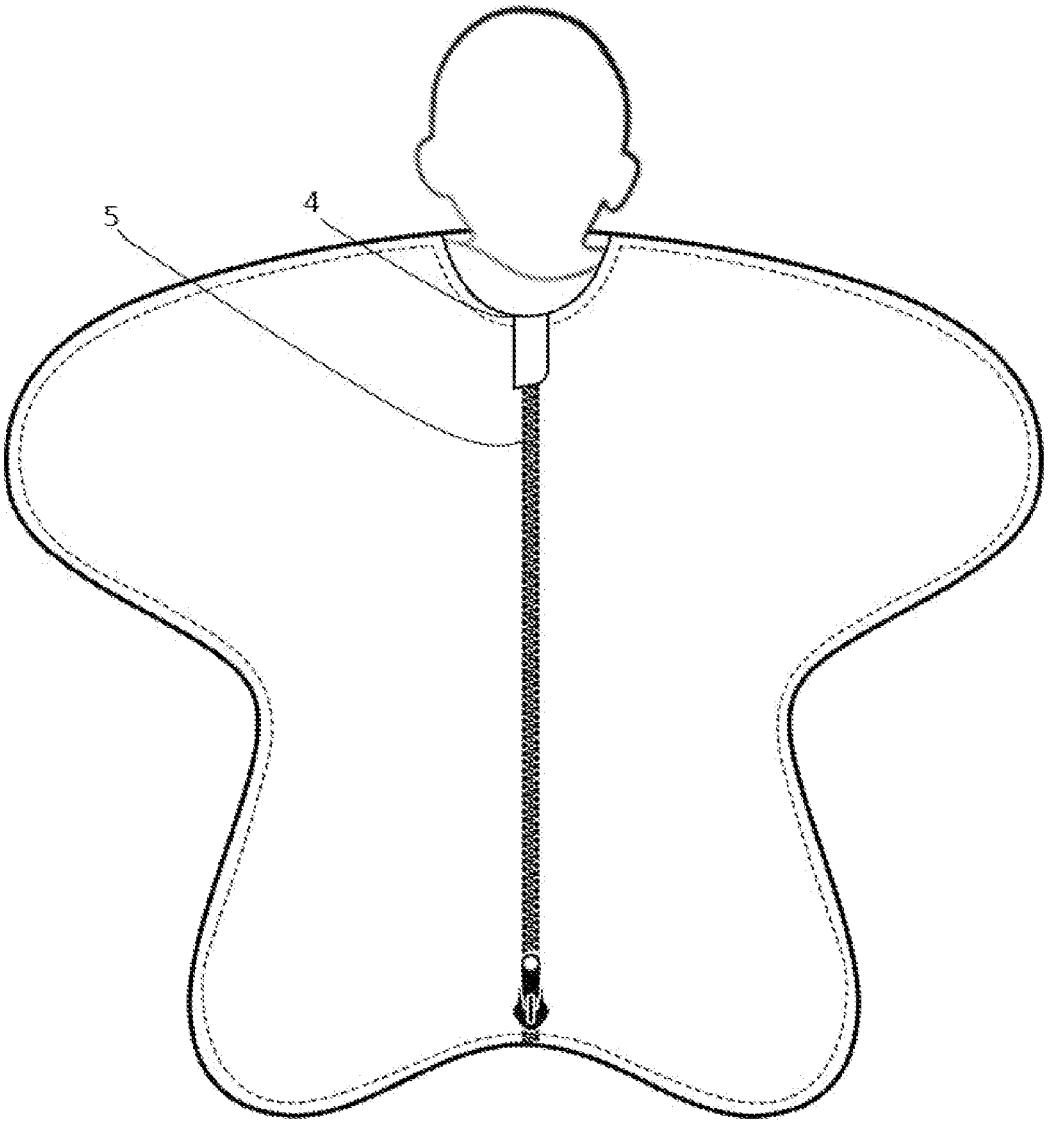
FIG. 7 is a seventh schematic diagram of the baby swaddle in a usage state.

As shown in FIG. 7, preferably, a covering element is provided at a junction of the first connecting mechanism 5 and the neckline 4 to protect the baby from being scratched, and it is made of a flexible material.

It is understandable that the first connecting mechanism 5 can be fully or partially opened, and can be adjusted as needed. For example, to put the baby into the baby swaddle or take the baby from the baby swaddle, the first connecting mechanism 5 can be fully opened for easy operation. It is worth noting that the first connecting mechanism 5 can be opened from the bottom to facilitate diaper changes.

It is worth noting that a free end of the left wing portion 12 is provided with first adhesive portion 6. The first adhesive portion 6 includes one end connected to the free end of the left wing portion 12 and the other end forming a first opening with the left wing portion 12. A tip of the left wing portion 12 is provided with a second opening, which facilitates a left hand of the baby to extend out and is suitable for babies in different age stages. The first adhesive portion 6 is configured to cover the second opening and prevent the left hand of the baby from extending out while sleeping or in cold weather, so as to prevent the baby from catching cold. A free end of the right wing portion 11 is provided with a third covering portion. The third covering portion includes one end connected to the free end of the right wing portion 11 and the other end forming a third opening with the right wing portion 11. A tip of the right wing portion 11 is provided with a fourth opening, which facilitates a right hand of the baby to extend out and is suitable for babies in different age stages. The third covering portion is configured to cover the fourth opening and prevent the right hand of the baby from extending out while sleeping or in cold weather, so as to prevent the baby from catching cold. It is understandable that the first adhesive portion 6 may be adhered to any position of the right wing portion 11, and the position is adjustable according to the actual situation for a suitable tightness of wrap-up. The left wing portion 12 can wrap the right wing portion 11 to cover the baby's chest and portion of the belly. The design has a wide coverage range and will not tightly swaddle the baby, making the baby feel comfortable.

It should be noted that the first adhesive portion 6 is foldable along a connection between the first adhesive portion 6 and the left wing portion 12, and the third covering portion is foldable along a connection between the third covering portion and the right wing portion 11. The baby's left and right hands can be curled up in front of the chest, or unfolded and extended into the left wing portion 12 and the right wing portion 11. The free ends of the left wing portion 12 and the right wing portion 11 are respectively provided with the first adhesive portion 6 and the third covering portion, and the first adhesive portion 6 and the third covering portion can prevent the unfolded hands of the baby from being exposed. When the baby's hands need to be exposed, the first adhesive portion 6 can be folded along the connection between the first adhesive portion 6 and the left wing portion 12, and the third covering portion can be folded along the connection between the third covering portion and the right wing portion 11. The design is simple and reasonable, increases the usage state of the baby swaddle, and extends the versatility and scope of the baby swaddle.

In some implementations, inwardly tightened first arc-shaped structure 3 is provided at a transition from the left wing portion 12 to the left leg portion 14, and inwardly tightened second arc-shaped structure 2 is provided at a transition from the right wing portion 11 to the right leg portion 13. The first arc-shaped structure 3 and the second arc-shaped structure 2 are symmetrical about the first connecting mechanism 5, which conforms to ergonomics and improves the comfort of the baby in the baby swaddle.

It is worth noting that the free end of the left leg portion 14 is provided with first covering portion 7. The first covering portion 7 includes one end connected to the free end of the left leg portion 14 and the other end forming a fifth opening with the left leg portion 14. A tip of the left leg portion 14 is provided with a seventh opening, which facilitates a left foot of the baby to extend out and is suitable for babies in different age stages. The first covering portion 7 is configured to cover the seventh opening, so as to prevent the left foot of the baby from extending out and protect the baby from catching cold. A free end of the right leg portion 13 is provided with second covering portion 8. The second covering portion 8 includes one end connected to the free end of the right leg portion 13 and the other end forming a sixth opening with the right leg portion 13. A tip of the right leg portion 13 is provided with an eighth opening, which facilitates a right foot of the baby to extend out and is suitable for babies in different age stages. The second covering portion 8 is configured to cover the eighth opening, so as to prevent the right foot of the baby from extending out and protect the baby from catching cold.

The first covering portion 7 is foldable along a connection between the first covering portion 7 and the left leg portion 14, and the second covering portion 8 is foldable along a connection between the second covering portion 8 and the right leg portion 13. The baby's left and right feet can be curled up together or extended to the left leg portion 14 and right leg portion 13. The free ends of the left leg portion 14 and the right leg portion 13 are respectively provided with the first covering portion 7 and the second covering portion 8. The first covering portion 7 and the second covering portion 8 can prevent the baby's lefts from being exposed. When the baby's legs really need to be exposed, the first covering portion 7 can be folded along the connection between the first covering portion 7 and the left leg portion 14, and the second covering portion 8 can be folded along the connection between the second covering portion 8 and the right leg portion 13. The design increases the usage state of the baby swaddle and can protect the baby from catching cold.

It is understandable that the left wing portion 12 and the right wing portion 11 are integrated with the swaddle body 1, and the left leg portion 14 and the right leg portion 13 are also integrated with the swaddle body 1. The left wing portion 12, the right wing portion 11, the left leg portion 14, and the right leg portion 13 can provide ample space to prevent the baby's arms and legs from getting stuck and constrained, ensuring a comfortable experience for the baby.

It should be noted that one of the first adhesive portion 6 and the right wing portion 11 is provided with a first hook and the other thereof is provided with a first loop corresponding to the first hook. The first hook and the first loop form a hook-and-loop fastener. When it is necessary to wrap the baby up with the baby swaddle, the left wing portion 12 and the right wing portion 11 are connected through the first hook and the first loop. After the left wing portion 12 and the right wing portion 11 are connected, the baby's hands will not be exposed due to flipping or kicking so as to protect the baby from catching cold. Specifically, the hook-and-loop fastener component on the right wing portion 11 is located close to the third covering portion. There is at least one first hook and at least one first loop, and the first loop has a size greater than or equal to that of the first hook.

Figure 8:
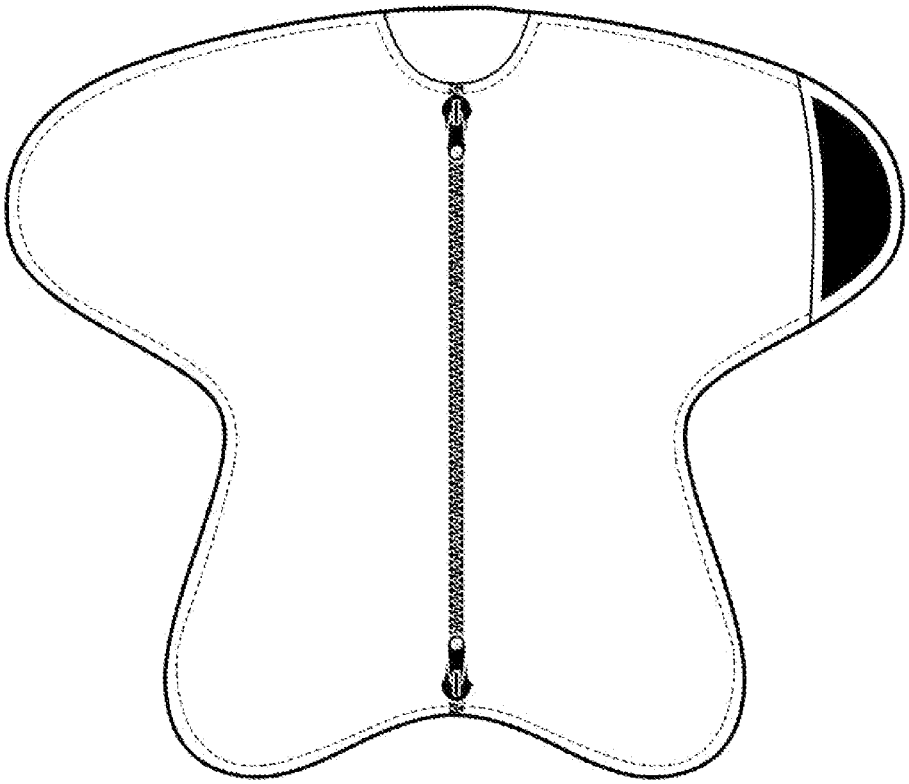
FIG. 8 is an eighth schematic diagram of the baby swaddle in a usage state.
Figure 9:
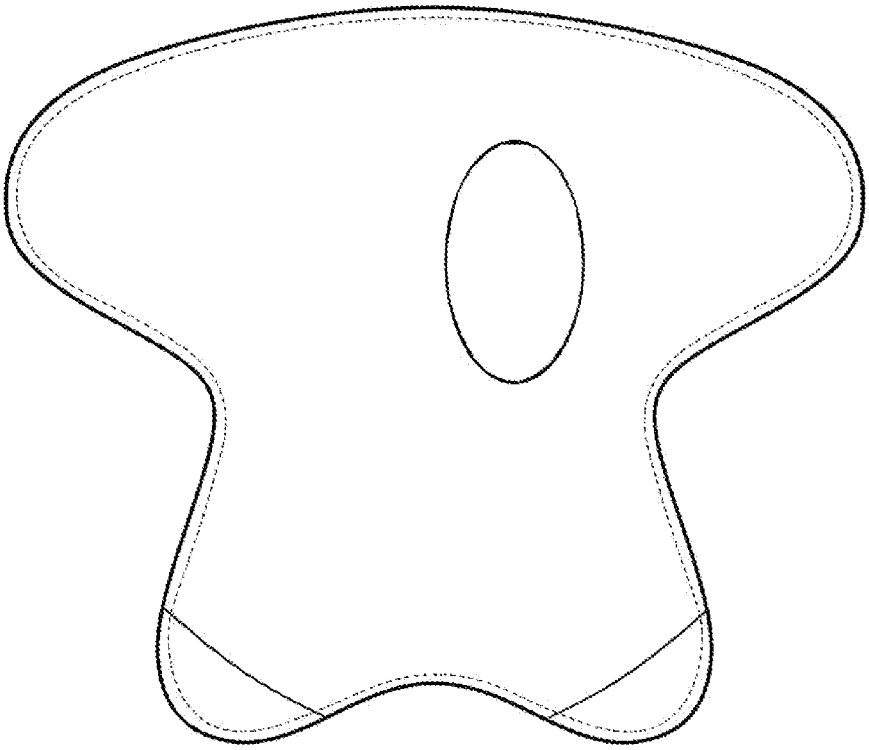
FIG. 9 is a rear view of the baby swaddle shown FIG. 8.

As shown in FIGS. 8 and 9, the left wing portion 12 is provided with the first hook. Correspondingly, a back of the swaddle body 1 is provided with the first loop corresponding to the first hook. The first loop is elliptical and has an area greater than that of the first hook. When the baby is wrapped up by the baby swaddle, the right wing portion 11 is first folded towards a left wing direction, then the left wing portion 12 is folded towards a right wing direction, and finally the first hook is connected to the first loop.

It should be noted that in the above implementations, the baby swaddle can be used for different age stages from newborns to babies around one year old. The baby swaddle can be used to wrap a baby from one to four months old, simulating the baby's wrapped state in the womb and helping the baby sleep soundly. Babies aged four to nine months are in a transitional period of sleep and do not require swaddling. They can put their hands and feet in the baby swaddle for free movement, thereby enhancing their sense of security and avoiding catching cold in cold weather. Babies aged nine months to one year have high physical resistance, have developed good sleep habits, and have entered an independent sleep period. Their hands and feet can be appropriately exposed, so the baby swaddle can be used as clothing or a sleeping bag. The baby swaddle has a wide range of applications for babies in different age stages, diverse usage methods, and simple operation, without the need to frequently change the baby swaddle or purchase additional sleeping bag as the baby grows, saving costs. More importantly, familiar smell makes the baby feel safe, and using the same baby swaddle can soothe the baby, ensuring high sleep quality and contributing to the healthy growth and stable personality development of the baby.

The present disclosure is described in detail above. Specific cases are used herein to illustrate the principle and implementation of the present disclosure, and the description of the above embodiments is only intended to help understand the core idea of the present disclosure. It should be noted that several improvements and modifications may also be made by those of ordinary skill in the art without departing from the principles of the present disclosure, which also fall within the protection scope of the claims of the present disclosure.

What is claimed is:

1. A baby swaddle, comprising a swaddle body, wherein an upper end of the swaddle body is provided with a neckline; a lower end of the neckline is provided with a first connecting mechanism; the first connecting mechanism extends downwards from the lower end of the neckline to a lower end of the swaddle body; the first connecting mechanism comprises a first side provided with a left wing portion and a second side provided with a right wing portion; a free end of at least one of the left wing portion and the right wing portion is provided with a first adhesive portion; and the first adhesive portion is configured to cover the right wing portion or the left wing portion, wherein the right wing portion and the left wing portion fold around the baby swaddle and at least portions of the right wing portion cover portions of the left wing portion;

wherein the swaddle body further comprises a left leg portion; the left leg portion is located at the same side as the left wing portion; the second side of the first connecting mechanism is further provided with a right leg portion; the right leg portion is located at the same side as the right wing portion; and the first adhesive portion is provided at the free end of the left wing portion and configured to cover the right wing portion;

wherein an inwardly tightened first arc-shaped structure is provided at a transition from the left wing portion to the left leg portion, and an inwardly tightened second arc-shaped structure is provided at a transition from the right wing portion to the right leg portion;

wherein a free end of the left leg portion is provided with a first covering portion; and the first covering portion comprises a first end connected to the free end of the left leg portion and a second end forming a fifth opening with the left leg portion;

wherein the first covering portion is foldable along a connection between the first covering portion and the left leg portion.

2. The baby swaddle according to claim 1, wherein the first adhesive portion comprises a first end connected to the free end of the left wing portion and a second end forming a first opening with the left wing portion; a tip of the left wing portion is provided with a second opening, wherein the second opening facilitates a left hand of a baby to extend out and is suitable for babies in different age stages; and the first adhesive portion is configured to cover the second opening and adhered to any position of the right wing portion.

3. The baby swaddle according to claim 2, wherein the free end of the right wing portion is provided with a third covering portion; the third covering portion comprises a first end connected to the free end of the right wing portion and a second end forming a third opening with the right wing portion; a tip of the right wing portion is provided with a fourth opening, wherein the fourth opening facilitates a right hand of the baby to extend out and is suitable for babies in different age stages; and the third covering portion is configured to cover the fourth opening.

4. The baby swaddle according to claim 1, wherein the baby swaddle is symmetrical about the first connecting mechanism in a left-to-right direction; and when the left wing portion covers the right wing portion, a chest and a portion of a belly of a baby are covered.

5. The baby swaddle according to claim 1, wherein one of the first adhesive portion and the right wing portion is provided with a first hook and the other of the first adhesive portion and the right wing portion is provided with a first loop corresponding to the first hook; or the swaddle body is provided with the first loop corresponding to the first hook; the first hook and the first loop form a hook-and-loop fastener; and the left wing portion and the right wing portion, or the left wing portion and the swaddle body, or the right wing portion and the swaddle body, are connected through the first hook and the first loop.

6. The baby swaddle according to claim 5, wherein there is at least one first hook and at least one first loop; and the first loop has a size greater than or equal to a size of the first hook.

7. The baby swaddle according to claim 5, wherein the first adhesive portion is foldable along a connection between the first adhesive portion and the left wing portion, and a third covering portion is foldable along a connection between the third covering portion and the right wing portion.

8. The baby swaddle according to claim 1, wherein a free end of the right leg portion is provided with a second covering portion; and the second covering portion comprises a first end connected to the free end of the right leg portion and a second end forming a sixth opening with the right leg portion.

9. The baby swaddle according to claim 8, wherein the second covering portion is foldable along a connection between the second covering portion and the right leg portion.

10. The baby swaddle according to claim 1, wherein the first connecting mechanism is fully or partially openable.

11. The baby swaddle according to claim 10, wherein the first connecting mechanism is openable from a bottom to facilitate a diaper change for a baby.

12. The baby swaddle according to claim 1, wherein the left wing portion and the right wing portion are integrated with the swaddle body, and the left leg portion and the right leg portion are further integrated with the swaddle body.

* * * * *